US010968791B2

(12) United States Patent
Hosogi et al.

(10) Patent No.: US 10,968,791 B2
(45) Date of Patent: Apr. 6, 2021

(54) CONTROL DEVICE AND CONTROL METHOD FOR ONBOARD ENGINE

(71) Applicants: TOYOTA JIDOSHA KABUSHIKI KAISHA, Toyota (JP); AISIN SEIKI KABUSHIKI KAISHA, Kariya (JP)

(72) Inventors: Takayuki Hosogi, Toyota (JP); Hisayuki Ito, Toyota (JP); Noboru Takagi, Toyota (JP); Kazuyoshi Shimatani, Hamamatsu (JP); Takahiko Aoyagi, Anjo (JP); Masahiro Yoshida, Toyota (JP); Yoshinobu Uchiyama, Toyota (JP); Toshiki Sato, Takahama (JP); Hirotaka Watanabe, Anjo (JP)

(73) Assignees: TOYOTA JIDOSHA KABUSHIKI KAISHA, Toyota (JP); AISIN SEIKI KABUSHIKI KAISHA, Kariya (JP)

( * ) Notice: Subject to any disclaimer, the term of this patent is extended or adjusted under 35 U.S.C. 154(b) by 7 days.

(21) Appl. No.: 16/467,292

(22) PCT Filed: Dec. 22, 2017

(86) PCT No.: PCT/JP2017/046169
§ 371 (c)(1),
(2) Date: Jun. 6, 2019

(87) PCT Pub. No.: WO2018/117257
PCT Pub. Date: Jun. 28, 2018

(65) Prior Publication Data

US 2020/0072100 A1 Mar. 5, 2020

(30) Foreign Application Priority Data

Dec. 22, 2016 (JP) ..... JP2016-249950

(51) Int. Cl.
*F01M 1/16* (2006.01)
*F01M 1/20* (2006.01)
(Continued)

(52) U.S. Cl.
CPC ..... *F01M 1/16* (2013.01); *F01M 1/20* (2013.01); *F01L 2001/34426* (2013.01);
(Continued)

(58) Field of Classification Search
CPC ... F01M 1/16; F01M 1/20; F01L 2001/34426; F02D 45/00; F02D 2200/023; F02D 2200/024
(Continued)

(56) References Cited

U.S. PATENT DOCUMENTS

2019/0195164 A1* 6/2019 Hirata ..... F02D 41/08

FOREIGN PATENT DOCUMENTS

JP 2012-87729 A 6/2012
JP 2013-231365 A 11/2013

OTHER PUBLICATIONS

International Search Report dated Mar. 27, 2018, in PCT/JP2017/046169 filed on Dec. 22, 2017.

* cited by examiner

*Primary Examiner* — Joseph J Dallo
*Assistant Examiner* — Yi-Kai Wang
(74) *Attorney, Agent, or Firm* — Oblon, McClelland, Maier & Neustadt, L.L.P.

(57) ABSTRACT

A control device for an onboard engine is configured to control the oil discharge pressure of an oil pump and execute, when determining that there may be an abnormality in the control of the oil discharge pressure, a change process that increases the target discharge pressure to a value that is greater than that before it is determined that there may be an
(Continued)

abnormality in the control. When a discharge pressure sensor value in a situation in which the discharge pressure is being controlled based on the target discharge pressure increased through execution of the change process does not become greater than or equal to a discharge pressure threshold, the control device sets an upper limit for the engine rotation speed and increases the upper limit as the discharge pressure sensor value increases.

13 Claims, 6 Drawing Sheets

(51) Int. Cl.
*F01L 1/344* (2006.01)
*F02D 45/00* (2006.01)

(52) U.S. Cl.
CPC ..... *F01L 2820/043* (2013.01); *F02D 45/00* (2013.01); *F02D 2200/023* (2013.01); *F02D 2200/024* (2013.01)

(58) Field of Classification Search
USPC ..... 123/196 CP
See application file for complete search history.

Fig.7
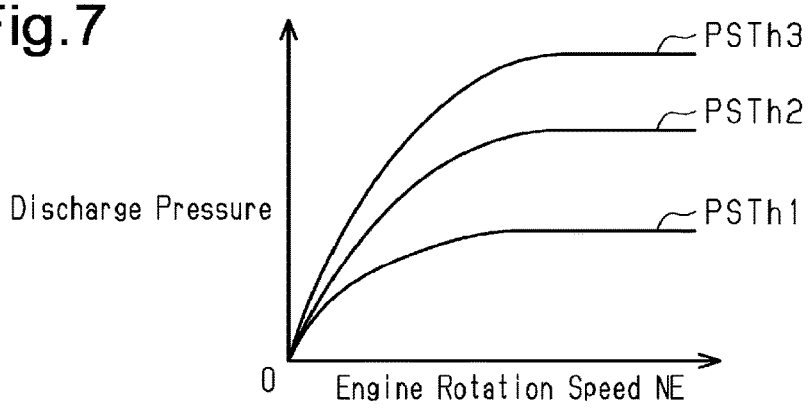
Fig.8A
Fig.8B
Fig.8C
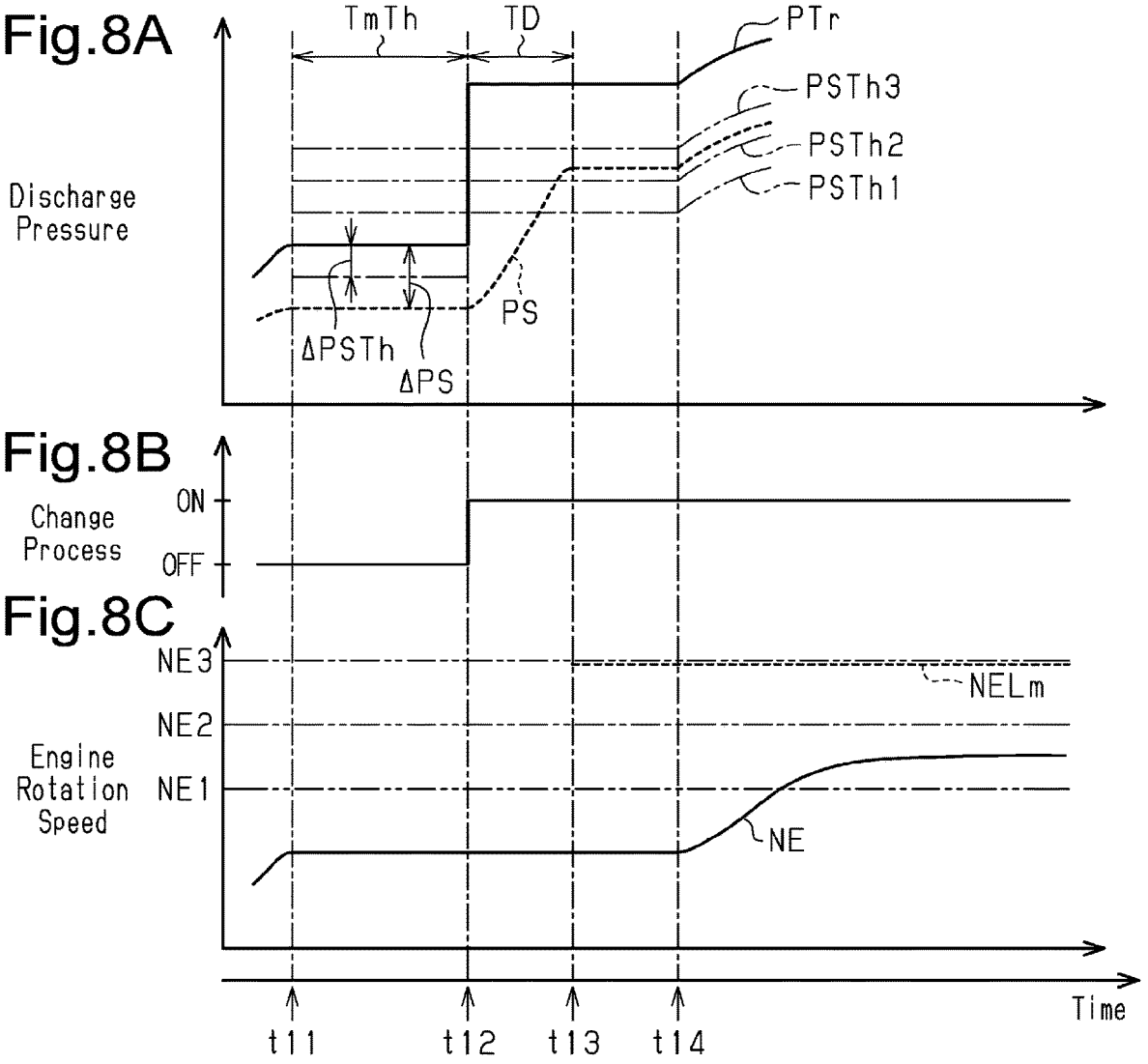

CONTROL DEVICE AND CONTROL METHOD FOR ONBOARD ENGINE

CROSS-REFERENCE TO RELATED APPLICATIONS

This application is a United States national stage application of International Application No. PCT/JP2017/046169, filed Dec. 22, 2017, which designates the United States, and claims priority to Japanese Patent Application No. 2016-249950 filed Dec. 22, 2016, and the entire contents of each of the above applications are hereby incorporated herein by reference in entirety.

TECHNICAL FIELD

The present invention relates to a control device and a control method adapted for an onboard engine having an oil pump capable of changing the oil discharge pressure.

BACKGROUND ART

Oil discharged from an oil pump circulates inside an engine. If the pressure of the oil circulating inside the engine is relatively low, there is a possibility that an adequate amount of oil is not supplied to the oil demanding portions, which are portions of the engine that require supply of oil. The oil demand at the oil demanding portions tends to increase as the engine rotation speed increases.

In this regard, for example, the engine control device described in Patent Document 1 executes failsafe control. Specifically, the pressure of oil circulating inside the engine cannot be increased to a pressure higher than a pressure threshold in a situation in which the engine rotation speed is greater than or equal to a rotation speed threshold, the control device limits the engine rotation speed up to the rotation speed threshold. Execution of such failsafe control suppresses an increase in the demand of oil at the oil demanding portions. As a result, even if the amount of oil able to be supplied to the oil demanding portions is relatively small, the demand for oil at the oil demanding portions and the amount of oil that is actually supplied to the oil demanding portions do not deviate from each other significantly.

PRIOR ART DOCUMENT

Patent Document

Patent Document 1: Japanese Laid-Open Patent Publication No. 2012-87729

SUMMARY OF THE INVENTION

Problems that the Invention Solves

During the execution of the above-mentioned failsafe control, if the engine rotation speed reaches an upper limit when the engine rotation speed is increased in an attempt to accelerate the vehicle, the vehicle cannot be readily accelerated.

Means for Solving the Problems

In accordance with one aspect, a control device for an onboard engine is provided. The onboard engine includes an oil pump capable of changing a discharge pressure and a sensor configured to detect a pressure of oil discharged from the oil pump. The control device includes a discharge pressure controlling section, an abnormality determining section, a target changing section, and an upper limit setting section. The discharge pressure controlling section is configured to control the oil discharge pressure of the oil pump based on a target discharge pressure that is a target value of a discharge pressure set for the oil pump and a discharge pressure sensor value that is a pressure of oil detected by the sensor. The abnormality determining section is configured to determine whether there may be an abnormality in a control of the oil discharge pressure. The target changing section is configured to, when the abnormality determining section determines that there may be an abnormality in the control of the oil discharge pressure, execute a change process in which the target changing section increases the target discharge pressure to a value that is greater than that before it is determined that there may be an abnormality in the control of the oil discharge pressure. The upper limit setting section is configured such that, when the discharge pressure sensor value in a situation in which the discharge pressure controlling section is controlling the oil discharge pressure based on the target discharge pressure increased through execution of the change process does not become greater than or equal to a discharge pressure threshold that is less than the target discharge pressure increased through the execution of the change process, the upper limit setting section sets an upper limit for an engine rotation speed and increases the upper limit as the discharge pressure sensor value increases.

With the above-described configuration, when it is determined that there may be an abnormality in the control of the oil discharge pressure of the oil pump, the change process is executed to increase the target discharge pressure as compared to the value before the determination that there may be an abnormality in the control of the oil discharge pressure. Even if such an increase in the target discharge pressure does not cause the oil discharge pressure to be higher than or equal to the discharge pressure threshold, an upper limit is set for the engine rotation speed.

When setting an upper limit for the engine rotation speed, the above-described configuration increases the upper limit for the engine rotation speed as the discharge pressure sensor value increases. That is, in the case of setting an upper limit for the engine rotation speed, the target discharge pressure is first increased in an attempt to increase the oil supply amount. The greater the amount of oil able to be supplied to the oil demanding portions by driving the oil pump at that time, the higher the upper limit can be set. Accordingly, when the oil discharge pressure is relatively high, the engine rotation speed does not easily reach the upper limit. Therefore, even when the upper limit is set for the engine rotation speed, acceleration of the vehicle will not be poor.

On the other hand, with the above-described configuration, in the case in which the upper limit is set for the engine rotation speed, the smaller the amount of oil able to be supplied to the oil demanding portions due to a relatively low oil discharge pressure of the oil pump, the lower the upper limit can be set. Thus, when the oil discharge pressure is relatively low, the engine rotation speed tends to reach the upper limit, and it is possible to suppress an increase in the oil demand at the oil demanding portions. This limits an increase in the deviation between the demand for oil at the oil demanding portions and the amount of oil that is actually supplied to the oil demanding portions.

That is, with the above-described configuration, the value of the upper limit is determined in accordance with the value of the oil discharge pressure when the target discharge pressure is increased through the change process. Therefore, it is possible to achieve compatibility between suppression of an increase in the oil demand at the oil demanding portions and prevention of poor acceleration of the vehicle.

When there is an abnormality in the control of the oil discharge pressure of the oil pump, a deviation is likely to occur between the target discharge pressure and the discharge pressure sensor value. Thus, the abnormality determining section may be configured to determine that there may be an abnormality in the control of the oil discharge pressure when a duration of a state in which a difference between the discharge pressure sensor value and the target discharge pressure is greater than or equal to a difference threshold becomes longer than or equal to a duration threshold.

The target changing section may be configured to, in the change process, equalize the target discharge pressure with a maximum target discharge pressure that is a maximum value of the target discharge pressure able to be set for the oil pump. As a result, the discharge pressure sensor value when the target discharge pressure is increased through execution of the change process does not become greater than or equal to the discharge pressure threshold. When setting an upper limit for the engine rotation speed, the target discharge pressure is first changed to the maximum target discharge pressure, and the oil pump is driven at the maximum performance. This allows the oil discharge pressure of the oil pump to be maximized when an upper limit is set for the engine rotation speed. Therefore, the upper limit for the engine rotation speed can be set in accordance with the maximum discharge performance of the oil pump at that time. This maximally suppresses poor vehicle acceleration, while inhibiting the shortage of oil supplied to the oil demanding portions.

An oil pump may be configured to be driven synchronously with rotation of the crankshaft of the engine. In such a configuration, when the oil pump can be driven normally, the oil discharge pressure of the oil pump increases as the engine rotation speed increases. In this regard, in the above-described control device, the discharge pressure threshold is preferably set to a greater value when the engine rotation speed is relatively high than when the engine rotation speed is relatively low. With this configuration, the discharge pressure threshold is greater when the oil discharge pressure is expected to increase than when the discharge pressure is not expected to increase. As a result, since the discharge pressure threshold can be set to an appropriate value, it is possible to increase the accuracy of determination as to whether the upper limit should be set for the engine rotation speed.

Specifically, the upper limit setting section may be configured to, when setting the upper limit for the engine rotation speed, set the upper limit greater when the discharge pressure sensor value is greater than or equal to an upper limit setting threshold that is less than the discharge pressure threshold than when the discharge pressure sensor value is less than the upper limit setting threshold. In this case, the upper limit setting threshold is set to a value less than the discharge pressure threshold.

Even if an upper limit is set for the engine rotation speed due to a relatively small amount of oil able to be supplied to the oil demanding portions, such an abnormality may be temporary. In such a case, a sufficient amount of oil can be supplied to the oil demanding portions in the subsequent operation of the onboard engine. In this regard, the above-described control device preferably includes a memory section that stores a limitation operation history that indicates that the onboard engine was operated with an upper limit set for the engine rotation speed.

In this case, when the limitation operation history is stored in the memory section at the start of the onboard engine, the change process is executed regardless of whether the abnormality determining section determines that there may be an abnormality in the control of the oil discharge pressure. When the discharge pressure sensor value in a situation in which the oil discharge pressure is controlled based on the target discharge pressure increased through execution of the change process does not become greater than or equal to the discharge pressure threshold, it is determined that the amount of oil able to be supplied to the oil demanding portions is relatively small in the current operation state of the onboard engine. It is thus preferable to set an upper limit for the engine rotation speed in accordance with the discharge pressure sensor value. In contrast, when the discharge pressure sensor value becomes greater than or equal to the discharge pressure threshold, it is determined that a sufficient amount of oil can be supplied to the oil demanding portions during the current operation of the onboard engine. It is thus preferable not to set an upper limit for the engine rotation speed in this case. With this configuration, even when an upper limit was set in the previous operation of the onboard engine due to a relatively small amount of oil that was able to be supplied to the oil demanding portions, an upper limit is not set in the current operation of the onboard engine if a sufficient amount of oil can be supplied to the oil demanding portions. This configuration prevents an upper limit from being set unnecessarily.

Execution of the change process allows the oil pump to be driven in a state in which the target discharge pressure is higher than when the change process is not executed. This may eliminate an abnormality in the control of the oil discharge pressure. Therefore, when the discharge pressure sensor value in a situation in which the discharge pressure controlling section controls the oil discharge pressure based on the target discharge pressure increased through execution of the change process becomes greater than or equal to the discharge pressure threshold, it can be determined that the abnormality in the oil discharge pressure control has been eliminated. It is thus preferable to end the execution of the change process. With this configuration, when an abnormality in the oil discharge pressure control is eliminated by driving the oil pump in a state in which the target discharge pressure has been increased through execution of the change process, it is possible to restore the oil discharge pressure control to the normal state.

In accordance with another aspect, a control method for an onboard engine is provided. The onboard engine includes an oil pump capable of changing a discharge pressure and a sensor configured to detect a pressure of oil discharged from the oil pump. The control method includes: controlling the oil discharge pressure of the oil pump based on a target discharge pressure that is a target value of a discharge pressure set for the oil pump and a discharge pressure sensor value that is a pressure of oil detected by the sensor; determining whether there may be an abnormality in a control of the oil discharge pressure; when it is determined that there may be an abnormality in the control of the oil discharge pressure, executing a change process to increase the target discharge pressure to a value that is greater than that before it is determined that there may be an abnormality in the control of the oil discharge pressure; and when the discharge pressure sensor value in a situation in which the oil discharge pressure is being controlled based on the target discharge pressure increased through execution of the change process does not become greater than or equal to a discharge pressure threshold that is less than the target discharge pressure increased through the execution of the change process, setting an upper limit for an engine rotation speed and increasing the upper limit as the discharge pressure sensor value increases.

BRIEF DESCRIPTION OF THE DRAWINGS

FIG. 7 is a diagram showing a map for setting discharge pressure thresholds in accordance with the engine rotation speed.

FIG. 8A is a timing diagram showing changes in the discharge pressure sensor value and the target discharge pressure.

FIG. 8B is a timing diagram showing changes in the execution state of the change process.

FIG. 8C is a timing diagram showing changes in the engine rotation speed and points in time at which upper limits are set for the engine rotation speed.

MODES FOR CARRYING OUT THE INVENTION

A control device for an onboard engine according to an embodiment will now be described with reference to the drawings.

Figure 1:
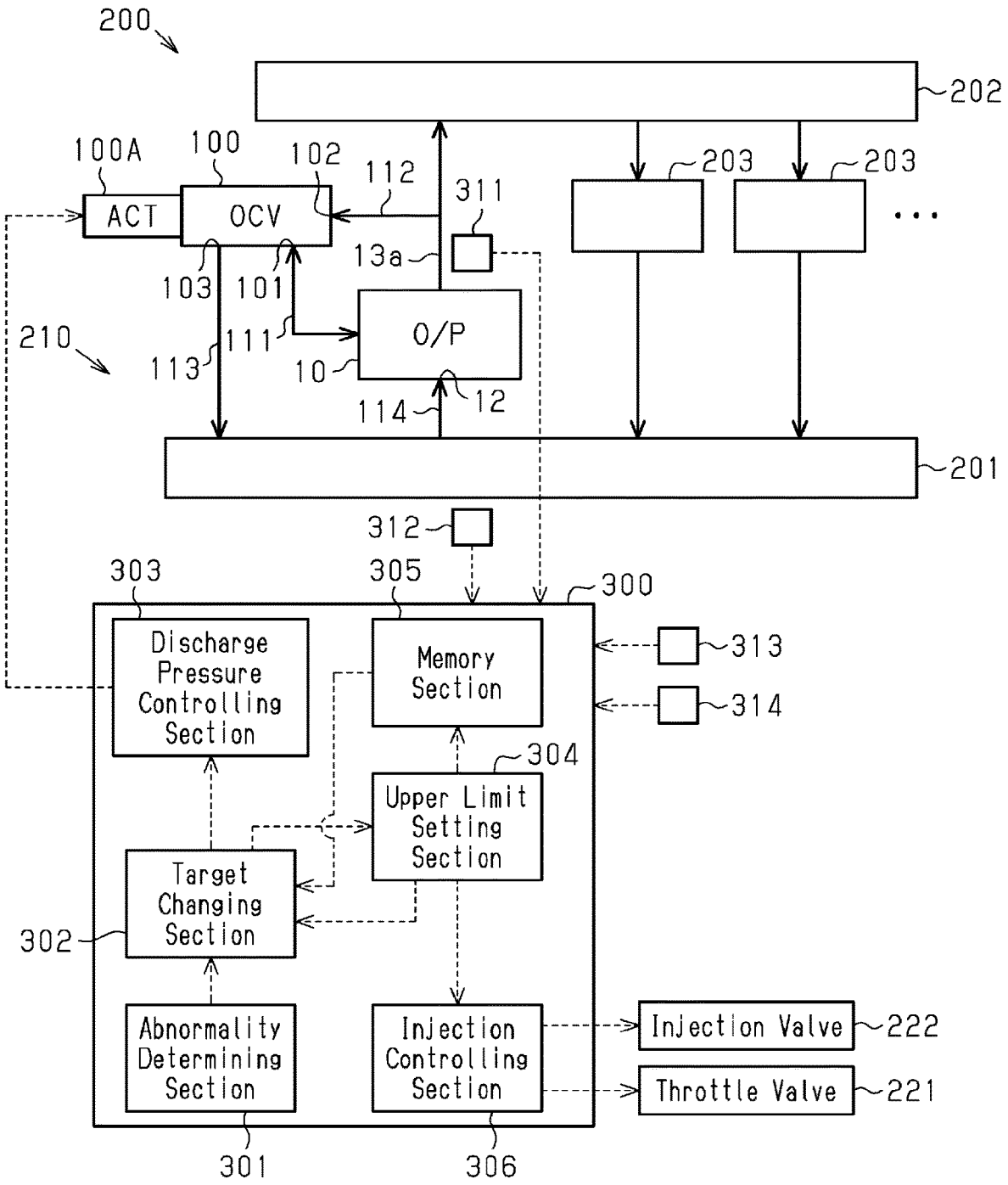
FIG. 1 is a schematic diagram showing the configuration of an onboard engine and its control device according to an embodiment.

FIG. 1 shows the circulation path of oil in an onboard engine (hereinafter simply referred to as an engine 200) equipped with a control device 300. As shown in FIG. 1, the engine 200 includes an oil pan 201, which stores oil, and a main oil gallery 202, which is supplied with oil in the oil pan 201 via an oil supplying device 210. The engine 200 also includes devices 203 that require supply of oil. Each of these devices 203 is an example of an oil demanding portion, to which oil needs to be supplied. The oil drained from the devices 203 is returned to the oil pan 201.

The engine 200 includes a throttle valve 221, which adjusts the intake air amount introduced into the combustion chamber via the intake passage, and an injection valve 222, which injects fuel. Air-fuel mixture containing the fuel injected from the injection valve 222 and the intake air is burned in the combustion chamber.

The oil supplying device 210 includes an oil pump 10, which is capable of changing the discharge pressure, and an oil control valve 100. The control device 300 controls operation of the oil control valve 100 to change the oil discharge pressure of the oil pump 10.

The oil pump 10 will now be described with reference to FIGS. 1, 2, and 3.

The oil pump 10 is a variable displacement pump driven by rotation of the crankshaft of the engine 200. As shown in FIGS. 2 and 3, the oil pump 10 includes an input shaft 11, which rotates in synchronization with the crankshaft, and a casing member CS, in which an accommodating space 40 is defined. The accommodating space 40 accommodates an inner rotor 50, which rotates integrally with the input shaft 11, an outer rotor 60, which is arranged on the radially outer side of the inner rotor 50, and an adjuster ring 70, which surrounds the outer rotor 60.

The casing member CS has a suction port 12 for drawing in oil and a discharge port 13 for discharging the internal oil to the outside of the casing member CS. As shown in FIG. 1, the suction port 12 communicates with a suction oil passage 114 leading to the oil pan 201. As shown in FIGS. 2 and 3, the discharge port 13 communicates with a discharge oil passage 13*a* leading to the main oil gallery 202.

Figure 2:
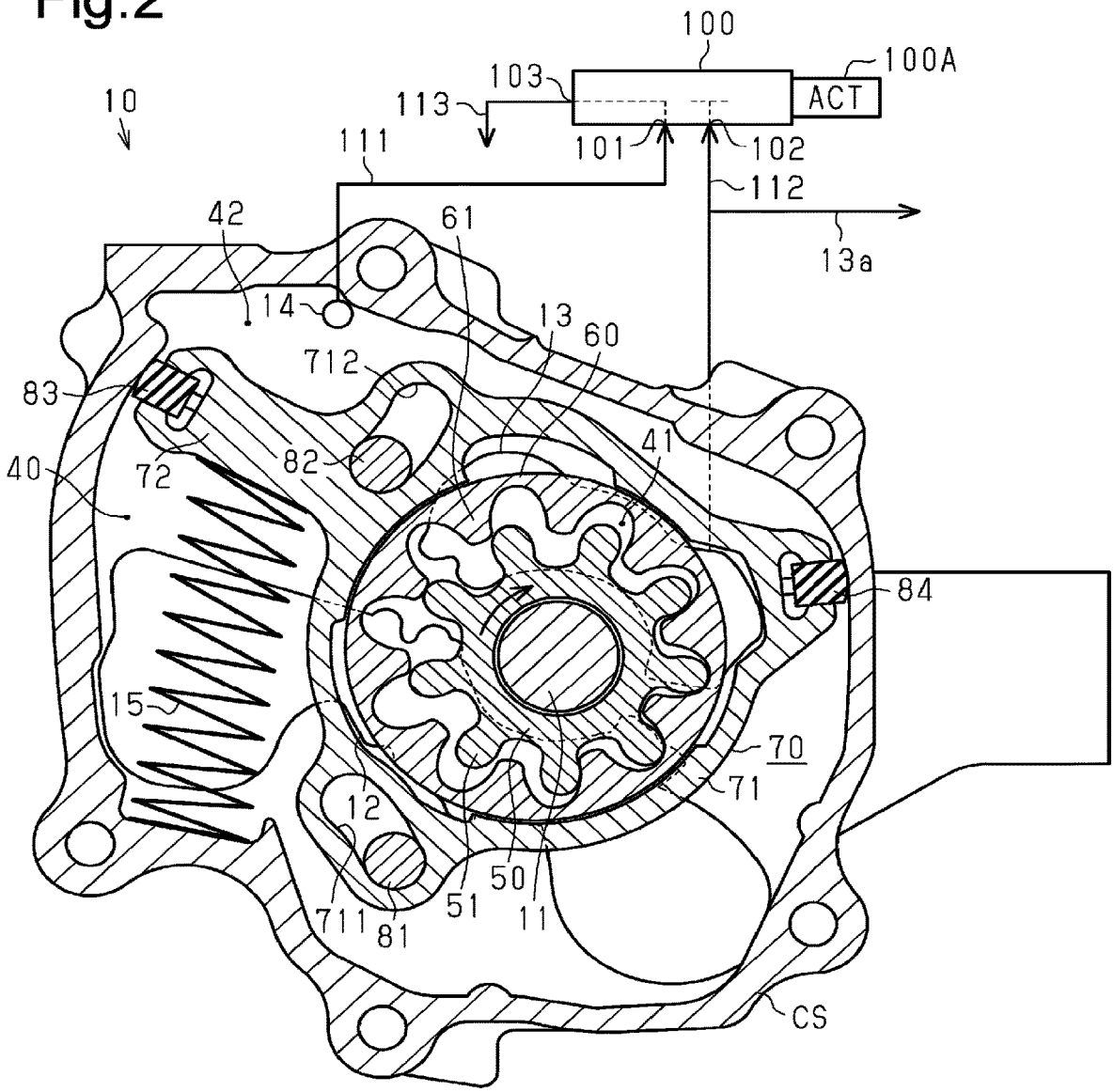
FIG. 2 is a cross-sectional view of an oil pump controlled by the control device in FIG. 1, illustrating a state in which the oil discharge pressure is maximized.
Figure 3:
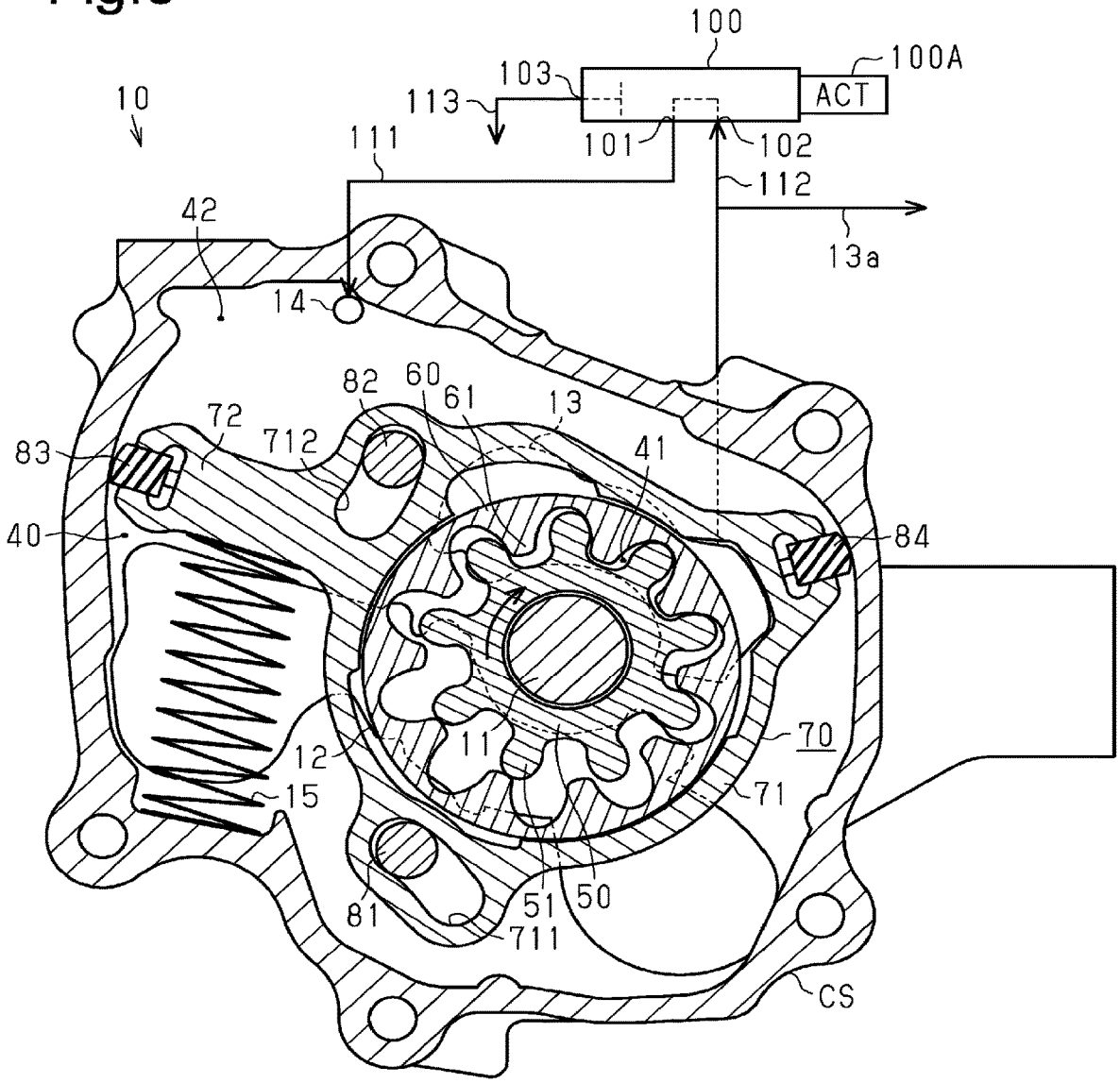
FIG. 3 is a cross-sectional view of the oil pump in FIG. 1, illustrating a state in which the oil discharge pressure is minimized.

As shown in FIGS. 2 and 3, the inner rotor 50 has external teeth 51 on the outer circumference, and the outer rotor 60 has internal teeth 61 on the inner circumference. The internal teeth 61 of the outer rotor 60 mesh with the external teeth 51 of the inner rotor 50. The number of the internal teeth 61 is one more than the number of the external teeth 51. The outer rotor 60 is rotationally supported by the adjuster ring 70.

The center of rotation of the outer rotor 60 is eccentric with respect to the center of rotation of the inner rotor 50. The external teeth 51 of the inner rotor 50 and the internal teeth 61 of the outer rotor 60 partially mesh with each other (in the right part in FIG. 2). The outer circumference of the inner rotor 50 and the inner circumference of the outer rotor 60 define a working chamber 41 between them. The working chamber 41 is filled with oil.

The working chamber 41 includes a portion ranging from the position where the external teeth 51 of the inner rotor 50 mesh with the internal teeth 61 of the outer rotor 60 to a predetermined position in the rotational direction of the input shaft 11, which is indicated by the arrow in FIG. 2. In this portion, the gap between the external teeth 51 and the internal teeth 61 gradually increases as the rotors 50 and 60 rotate. The portion where the gap between the external teeth 51 of the inner rotor 50 and the internal teeth 61 of the outer rotor 60 gradually increases communicates with the suction port 12. The working chamber 41 also includes a portion where the gap between the external teeth 51 of the inner rotor 50 and the internal teeth 61 of the outer rotor 60 gradually decreases as the rotor 50 and 60 rotate. This portion communicates with the discharge port 13.

When the oil pump 10 is driven, rotation of the input shaft 11 causes the respective rotors 50 and 60 to rotate while meshing with each other. Then, the oil stored in the oil pan 201 is drawn into the working chamber 41 from the suction port 12 via the suction oil passage 114 and is discharged to the discharge oil passage 13*a* from the discharge port 13.

The adjuster ring 70 has an annular main body 71, which holds the outer rotor 60, and a projection 72, which projects in the radial direction of the rotors 50 and 60 from the outer circumference of the main body 71. The main body 71 of the adjuster ring 70 has elongated holes 711 and 712, which each extend in a specified direction. The elongated holes 711 and 712 respectively receive guide pins 81 and 82 fixed to the casing member CS. This allows the adjuster ring 70 to be displaced in the extending direction of the elongated holes 711 and 712.

A first sealing member 83 is provided at the distal end of the projection 72 of the adjuster ring 70, and a second sealing member 84 is provided in the main body 71. The sealing member 83 and 84 abut the side wall of the casing member CS to seal the space between the side wall and the outer circumference of the adjuster ring 70, so that the adjuster ring 70 and the sealing members 83 and 84 define a control oil chamber 42 in the accommodating space 40.

The control oil chamber 42 has an opening 14, which communicates with a control oil passage 111. Oil can be supplied from the oil control valve 100 to the control oil chamber 42 through the control oil passage 111 and the opening 14. The accommodating space 40 accommodates a spring 15 that applies an urging force in a direction reducing the volume of the control oil chamber 42 to the projection 72. The spring 15 is located on the opposite side of the projection 72 from the control oil chamber 42. FIG. 2 shows a state in which the inner pressure of the control oil chamber 42 is relatively low, so that the urging force of the spring 15 holds the adjuster ring 70 at a position where the volume of the control oil chamber 42 is minimized. In the present embodiment, the position of the adjuster ring 70 when the volume of the control oil chamber 42 is minimized, that is, the position of the adjuster ring 70 in FIG. 2 is referred to as an initial position.

When oil is supplied to the control oil chamber 42 to increase the inner pressure of the control oil chamber 42 in a situation in which the adjuster ring 70 is located at the initial position, the adjuster ring 70 is displaced from the initial position in a direction increasing the volume of the control oil chamber 42 against the urging force from the spring 15. That is, the adjuster ring 70 is displaced while rotating in the direction from the state shown in FIG. 2 to the state shown in FIG. 3 (the counterclockwise direction in FIG. 2). When oil is drained from the control oil chamber 42 by driving the oil control valve 100, the inner pressure of the control oil chamber 42 is decreased, so that the urging force of the spring 15 displaces the adjuster ring 70 in a direction decreasing the volume of the control oil chamber 42. That is, the adjuster ring 70 is displaced while rotating in the direction from the state shown in FIG. 3 to the state shown in FIG. 2 (the clockwise direction in FIG. 3). In other words, the position of the adjuster ring 70 is determined by the inner pressure of the control oil chamber 42 and the urging force of the spring 15. A change in the position of the adjuster ring 70 changes the relative position where the teeth 51 and 61 of the inner rotor 50 and the outer rotor 60 mesh each other with respect to the respective openings of the suction port 12 and the discharge port 13. Therefore, the discharge pressure, which is the pressure of the oil discharged from the discharge port 13, is changed by changing the position of the adjuster ring 70 by regulating the inner pressure of the control oil chamber 42.

Specifically, the oil discharge pressure of the oil pump 10 is maximized when the adjuster ring 70 is at the initial position as shown in FIG. 2. When the inner pressure of the control oil chamber 42 is increased from the state in which the oil discharge pressure is maximized as shown in FIG. 2, the increase in the inner pressure displaces the adjuster ring 70 while rotating the adjuster ring 70 counterclockwise in FIG. 2 against the urging force of the spring 15. As a result, the range that overlaps with the suction port 12 is reduced in the portion where the gap between the external teeth 51 and the internal teeth 61 gradually increases as the rotors 50 and 60 rotate, and the portion where the gap between the external teeth 51 and the internal teeth 61 gradually decreases partially overlaps with the suction port 12. This decreases the oil discharge pressure. In contrast, when the inner pressure of the control oil chamber 42 is decreased, the decrease in the inner pressure displaces the adjuster ring 70 while rotating the adjuster ring 70 clockwise in FIG. 3 by the urging force of the spring 15, so that the oil discharge pressure is increased.

The oil control valve 100 will now be described with reference to FIGS. 1, 2, and 3.

As shown in FIGS. 1 and 2, the oil control valve 100 is capable of switching the communication state of multiple oil passages by switching the position of a spool by driving an electromagnetic actuator 100A. That is, the oil control valve 100 has a control port 101, to which the control oil passage 111 is connected, a supply port 102, to which a supply oil passage 112 branching off a discharge oil passage 13*a* of the oil pump 10 is connected, and a drain port 103, to which a drain oil passage 113 for draining oil is connected. Then, a command current value Iocv to the actuator 100A is regulated to switch the position of the spool of the actuator 100A between a drain position (FIG. 2), at which the oil returned to the control port 101 is drained from the drain port 103, and a supply position (FIG. 3), at which the oil supplied to the supply port 102 is delivered to the control oil passage 111 from the control port 101.

The control device 300 will now be described with reference to FIG. 1. The control device 300 may be circuitry including: 1) one or more processors that operate according to a computer program (software); 2) one or more dedicated hardware circuits (application specific integrated circuits: ASIC) that execute at least part of various processes, or 3) a combination thereof. The processor includes a CPU and memories such as a RAM and a ROM. The memories store program codes or commands configured to cause the CPU to execute processes. The memory, or computer readable medium, includes any type of medium that is accessible by general-purpose computers and dedicated computers.

As shown in FIG. 1, the control device 300 is electrically connected to a discharge pressure sensor 311, a temperature sensor 312, a crank angle sensor 313, and an accelerator operation amount sensor 314. The discharge pressure sensor 311 detects a discharge pressure sensor value PS, which is the pressure of the oil discharged from the oil pump 10, and the temperature sensor 312 detects an oil temperature TMP, which is the temperature of the oil supplied to the oil pump 10. Further, the crank angle sensor 313 detects an engine rotation speed NE, which is the rotation speed of the crankshaft. The accelerator operation amount sensor 314 detects an accelerator operation amount ACC, which is the operation amount of the accelerator pedal by the driver of the vehicle. The control device 300 is configured to control operation of the engine 200 based on the information detected by the sensors 311 to 314.

The control device 300 includes, as functional sections for operating the engine 200, an abnormality determining section 301, a target changing section 302, a discharge pressure controlling section 303, an upper limit setting section 304, a memory section 305, and an injection controlling section 306. Using these functional sections, the control device 300 sets an upper limit NELm for the engine rotation speed NE when the discharge pressure sensor value PS deviates from a target discharge pressure PTr, which is a target value of the oil discharge pressure set for the oil pump 10.

The abnormality determining section 301 determines whether there may be an abnormality in the control of the oil discharge pressure of the oil pump 10. Then, when determining that there may be an abnormality in the control of the oil discharge pressure, the abnormality determining section 301 outputs an abnormality signal, which indicates the possibility of an abnormality, to the target changing section 302.

The target changing section 302 derives the target discharge pressure PTr. When receiving the abnormality signal from the abnormality determining section 301, the target changing section 302 executes a change process. In the change process, the target changing section 302 increases the target discharge pressure PTr to a value that is greater than that before receiving the abnormality signal, that is, that before it was determined that there may be an abnormality in the control of the oil discharge pressure. The target changing section 302 outputs the derived target discharge pressure PTr to the discharge pressure controlling section 303. Also, when deriving the target discharge pressure PTr through execution of the change process, the target changing section 302 outputs a target changing signal, which indicates the derivation of the target discharge pressure PTr, to the upper limit setting section 304.

The discharge pressure controlling section 303 controls the operation of the oil pump 10 by controlling the operation of the actuator 100A of the oil pump 10 based on the received target discharge pressure PTr and the discharge pressure sensor value PS detected by the discharge pressure sensor 311. Specifically, the discharge pressure controlling section 303 derives the command current value Iocv through feedback control using the target discharge pressure PTr and the discharge pressure sensor value PS and delivers the command current value Iocv to the actuator 100A, thereby controlling the operation of the actuator 100A. Accordingly, the oil discharge pressure of the oil pump 10 is regulated.

When receiving the target changing signal from the target changing section 302, the upper limit setting section 304 determines whether to set the upper limit NELm for the engine rotation speed NE. When determining to set the upper limit NELm, the upper limit setting section 304 determines the upper limit NELm using the discharge pressure sensor value PS and outputs the upper limit NELm to the injection controlling section 306. When determining to set the upper limit NELm for the engine rotation speed NE, the upper limit setting section 304 stores, in the memory section 305, a limitation operation history that indicates that the engine 200 has been operated with the upper limit NELm set.

The injection controlling section 306 controls the fuel injection amount of the injection valve 222 and the opening degree of the throttle valve 221 based on the received accelerator operation amount ACC. At this time, if the upper limit setting section 304 has set the upper limit NELm for the engine rotation speed NE, the injection controlling section 306 adjusts the fuel injection amount of the injection valve 222 and the opening degree of the throttle valve 221 such that the engine rotation speed NE does not exceed the upper limit NELm.

Next, with reference to FIG. 4, the processing routine executed by the abnormality determining section 301 to determine whether there may be an abnormality in the control of the oil discharge pressure of the oil pump 10 will be described. This processing routine is executed after starting of the engine 200 is completed.

Figure 4:
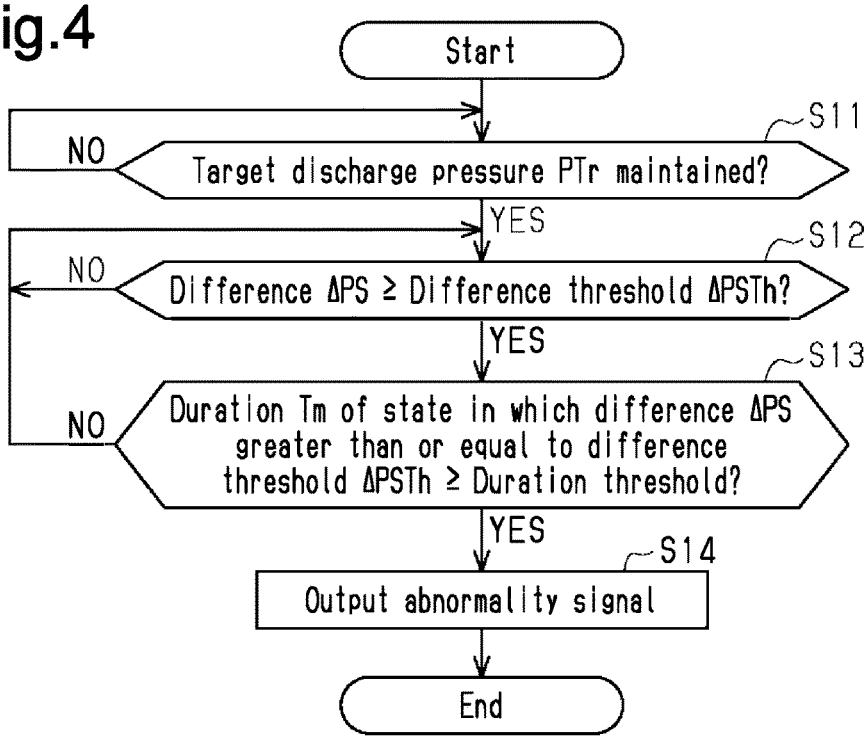
FIG. 4 is a flowchart illustrating a processing routine executed by an abnormality determining section of the control device in FIG. 1.

As shown in FIG. 4, in this processing routine, the abnormality determining section 301 determines whether the target discharge pressure PTr is maintained (step S11). For example, it is determined that the target discharge pressure PTr is maintained when the change speed per unit time of the target discharge pressure PTr derived by the target changing section 302 is less than a change speed threshold. In contrast, it is not determined that the target discharge pressure PTr is maintained when the change speed is greater than or equal to the change speed threshold. When it is not determined that the target discharge pressure PTr is maintained (step S11: NO), the abnormality determining section 301 again executes the determination process of step S11.

When it is determined that the target discharge pressure PTr is maintained (step S11: YES), the abnormality determining section 301 calculates the difference ΔPS (ΔPS=|PTr−PS|) between the target discharge pressure PTr and the discharge pressure sensor value PS and determines whether the difference ΔPS is greater than or equal to a difference threshold ΔPSTh (step S12). In the case where the oil discharge pressure of the oil pump 10 can be controlled normally, the difference ΔPS is unlikely to increase in a situation in which the target discharge pressure PTr is maintained. Accordingly, in the present embodiment, the difference threshold ΔPSTh is defined as a reference for determining whether the oil discharge pressure can be controlled normally. Therefore, when the difference ΔPS is smaller than the difference threshold ΔPSTh, it is determined that the control of the oil discharge pressure is normal. In contrast, when the difference ΔPS is greater than or equal to the difference threshold ΔPSTh, it cannot be determined that the oil discharge pressure control is normal.

Cases in which the oil discharge pressure cannot be controlled normally include a case in which the oil control valve 100 cannot be driven normally, a case in which the adjuster ring 70 cannot be properly displaced in the oil pump 10, and a case in which there is an abnormality in the temperature sensor 312. That is, if there is an abnormality in the oil control valve 100, the oil control valve 100 cannot properly control the inner pressure of the control oil chamber 42 of the oil pump 10. In this case, since the position of the adjuster ring 70 cannot be properly controlled, it is difficult to reduce the difference ΔPS between the target discharge pressure PTr and the discharge pressure sensor value PS.

Also, when the adjuster ring 70 cannot be properly displaced in the oil pump 10, even a proper adjustment of the inner pressure of the control oil chamber 42 will not readily displace the adjuster ring 70. The oil discharge pressure thus cannot be readily changed. Therefore, it is difficult to reduce the difference ΔPS between the target discharge pressure PTr and the discharge pressure sensor value PS.

The target discharge pressure PTr is set in accordance with the oil temperature TMP, which is detected by the temperature sensor 312. The setting of the target discharge pressure PTr will be discussed below. Therefore, when there is an abnormality in the temperature sensor 312, the detected oil temperature TMP deviates from the actual oil temperature, so that the target discharge pressure PTr cannot be set to an appropriate value in some cases. When the target discharge pressure PTr cannot be set to an appropriate value as described above, the discharge pressure sensor value PS cannot be brought closer to the target discharge pressure PTr even by driving the oil pump 10 through operation of the oil control valve 100. The difference ΔPS thus cannot be reduced in some cases.

Referring back to the description of the flowchart of FIG. 4, if the difference ΔPS is less than the difference threshold ΔPSTh (NO) in step S12, the abnormality determining section 301 repeats the determination process of step S12. In contrast, when the difference ΔPS is greater than or equal to the difference threshold ΔPSTh (step S12: YES), the abnormality determining section 301 acquires a duration Tm of a state in which the difference ΔPS is greater than or equal to the difference threshold ΔPSTh and determines whether the duration Tm is longer than or equal to a duration threshold TmTh (step S13). If there may be an abnormality in the control of the oil discharge pressure of the oil pump 10, a state in which the difference ΔPS is greater than or equal to the difference threshold ΔPSTh continues for a certain period. In contrast, when there is no abnormality the control of the oil discharge pressure, that is, if the control is performed normally, the difference ΔPS may temporarily become greater than or equal to the difference threshold ΔPSTh. However, that state will not continue. Accordingly, in the present embodiment, the duration threshold TmTh is defined as a reference for determining whether the duration Tm of the state in which the difference ΔPS is greater than or equal to the difference threshold ΔPSTh is relatively long. Therefore, when the duration Tm is longer than or equal to the duration threshold TmTh, it is determined that there may be an abnormality in the control of the oil discharge pressure. In contrast, when the duration Tm is shorter than the duration threshold TmTh, it cannot be determined that there may be an abnormality in the control of the oil discharge pressure.

If the duration Tm is shorter than the duration threshold TmTh (step S13: NO), the abnormality determining section 301 moves the process to the above-described step S12. If the duration Tm is longer than or equal to the duration threshold TmTh (step S13: YES), the abnormality determining section 301 outputs an abnormality signal to the target changing section 302 (step S14), and thereafter ends the processing routine.

Next, with reference to FIG. 5, the processing routine executed by the target changing section 302 to derive the target discharge pressure PTr will be described. The processing routine is executed at a predetermined control cycle.

Figure 5:
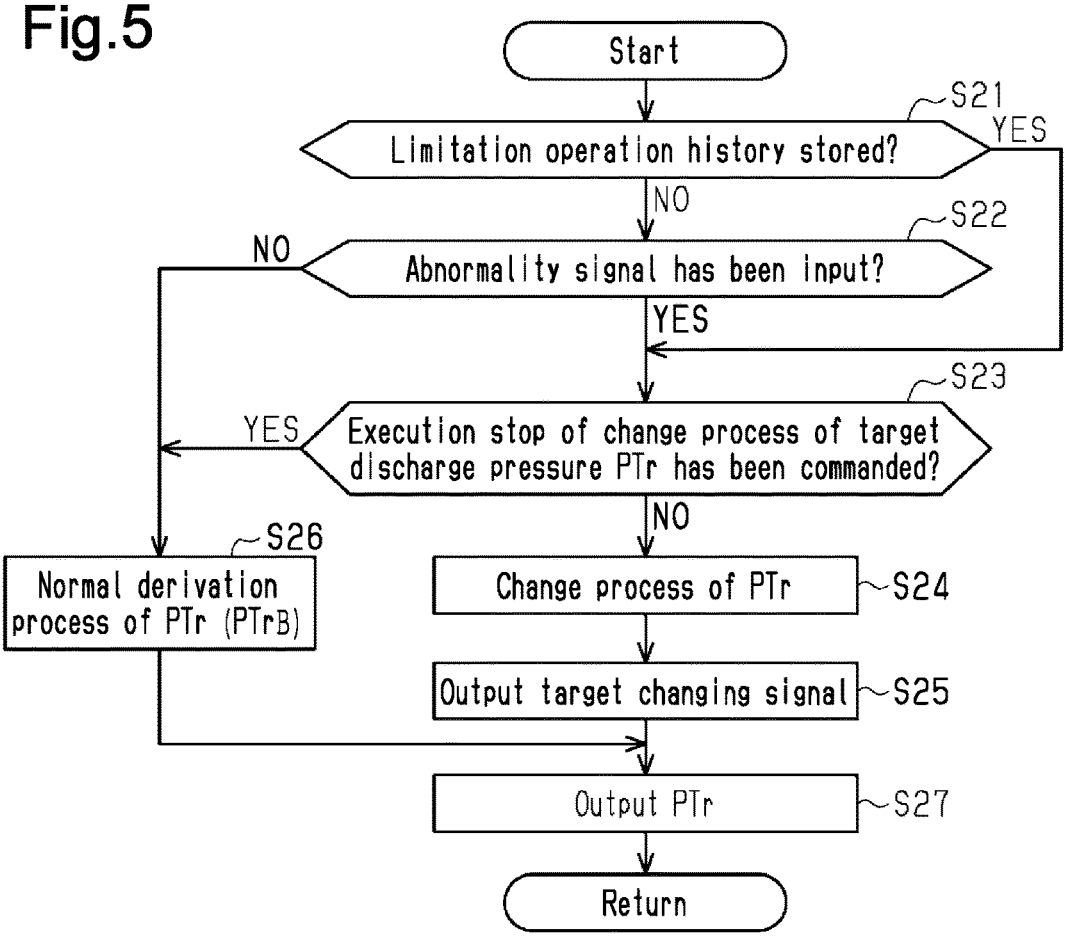
FIG. 5 is a flowchart illustrating a processing routine executed by a target changing section of the control device in FIG. 1.

As shown in FIG. 5, in this processing routine, the target changing section 302 determines whether the above-mentioned limitation operation history is stored in the memory section 305 (step S21). If the limitation operation history is stored in the memory section 305 (step S21: YES), the target changing section 302 moves the process to step S23, which will be discussed below. In contrast, if the limitation operation history is not stored in the memory section 305 (step S21: NO), the target changing section 302 determines whether an abnormality signal has been delivered from the abnormality determining section 301 (step S22). If no abnormality signal has been delivered from the abnormality determining section 301 (step S22: NO), the target changing section 302 moves the process to step S26, which will be discussed below. In contrast, If an abnormality signal has been delivered from the abnormality determining section 301 (step S22: YES), the target changing section 302 moves the process to the subsequent step S23.

In step S23, the target changing section 302 determines whether a command to stop execution of the change process of the target discharge pressure PTr has been delivered from the upper limit setting section 304. As will be described in detail below, the command to stop the execution is a command that is delivered by the upper limit setting section 304 to the target changing section 302 when the upper limit setting section 304 determines that the upper limit NELm does not need to be set for the engine rotation speed NE.

If a command to stop the execution has been delivered from the upper limit setting section 304 (step S23: YES), the target changing section 302 moves the process to step S26, which will be discussed below. In contrast, if no command to stop the execution has been delivered from the upper limit setting section 304 (step S23: NO), the target changing section 302 executes a change process for the target discharge pressure PTr. The maximum value of the oil discharge pressure of the oil pump 10 varies depending on the engine rotation speed NE and the oil temperature TMP at that time. Therefore, in this change process, the target changing section 302 derives the maximum value of the discharge pressure able to be set for the oil pump 10 from the relationship between the current engine rotation speed NE and the oil temperature TMP and equalizes pressure PTr with the derived maximum value of the discharge pressure. Specifically, in the change process, the target discharge pressure PTr is set to the discharge pressure attained when the oil pump 10 is in the state shown in FIG. 2. The maximum value of the discharge pressure able to be set increases as the engine rotation speed NE increases and as the oil temperature TMP decreases.

When derivation of the target discharge pressure PTr through the change process is completed, the target changing section 302 outputs the above-described target changing signal to the upper limit setting section 304 (step S25) and moves the process to step S27, which will be discussed below.

In step S26, the target changing section 302 executes a normal derivation process of the target discharge pressure PTr. In the normal derivation process, the target changing section 302 acquires required discharge pressures of the respective devices 203 in the engine 200 and sets the target discharge pressure PTr to the maximum required discharge pressure of the required discharge pressures. The required discharge pressures of the respective devices 203 tend to increase as the engine rotation speed NE increases and as the oil temperature TMP decreases. Therefore, the target discharge pressure PTr derived through the normal derivation process tends to increase as the engine rotation speed NE increases and as the oil temperature TMP decreases. In the present embodiment, the target discharge pressure PTr derived through the normal derivation process is also referred to as a reference target discharge pressure PTrB. When derivation of the target discharge pressure PTr through the normal derivation process is completed, the target changing section 302 moves the process to the next step S27.

In step S27, the target changing section 302 outputs the target discharge pressure PTr derived in step S24 or step S26 to the discharge pressure controlling section 303. Thereafter, the target changing section 302 temporarily ends the processing routine.

In the present embodiment, when it is not determined that there may be an abnormality in the control of the oil discharge pressure of the oil pump 10, the target changing section 302 executes the normal derivation process to equalize the target discharge pressure PTr with the reference target discharge pressure PTrB. In this situation, if it is determined that there may be an abnormality in the control of the oil discharge pressure, the target changing section 302 executes the change process to drive the target discharge pressure PTr. That is, the target discharge pressure PTr becomes higher than the target discharge pressure PTr before it is determined that there may be an abnormality, that is, the reference target discharge pressure PTrB.

Next, with reference to FIGS. 6 and 7, the processing routine executed by the upper limit setting section 304 will be described. This processing routine is executed when a predetermined delay time TD has elapsed since a target changing signal is delivered from the target changing section 302.

Figure 6:
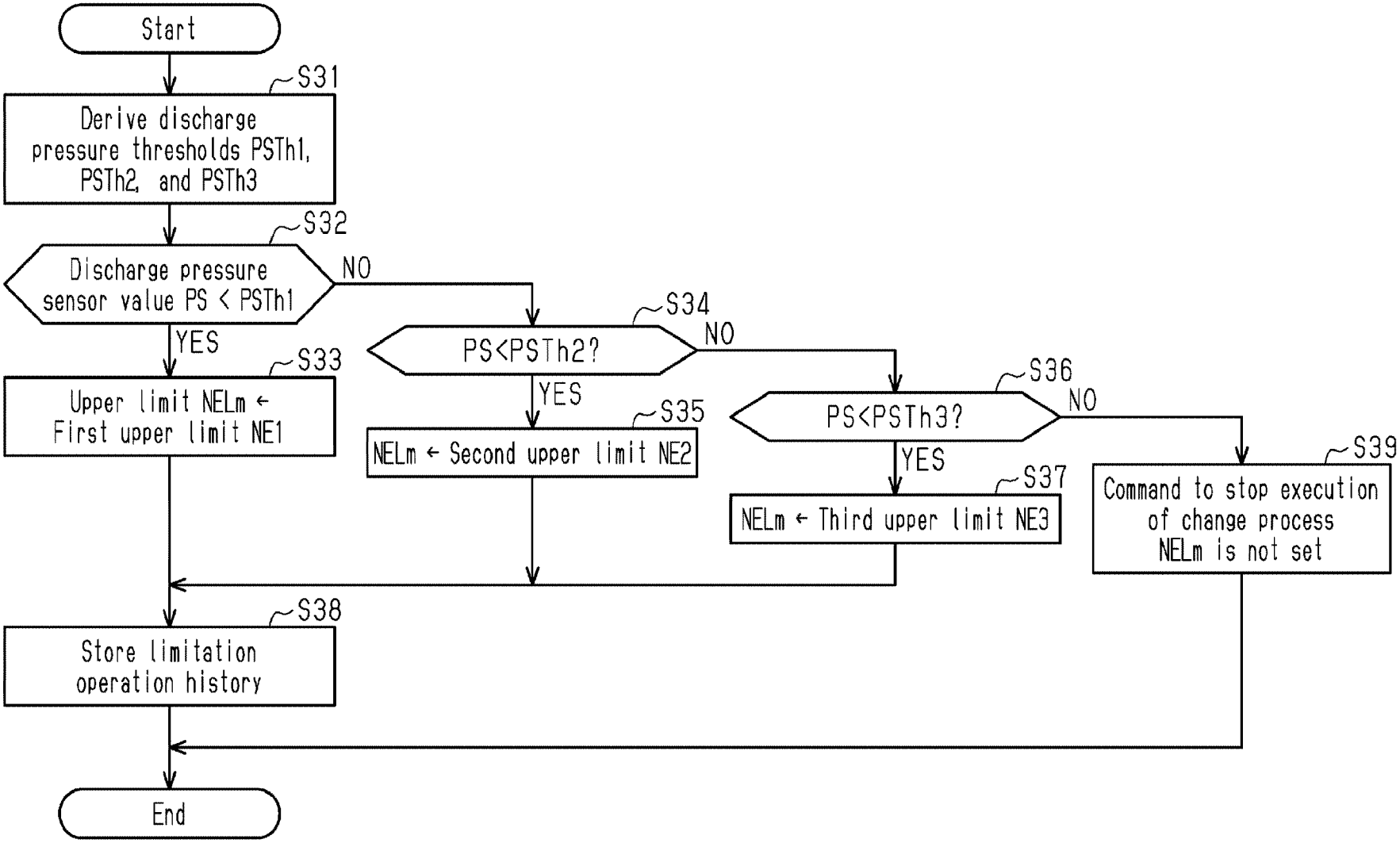
FIG. 6 is a flowchart illustrating a processing routine executed by an upper limit setting section of the control device in FIG. 1.

In this processing routine, the upper limit setting section 304 derives a first discharge pressure threshold PSTh1, a second discharge pressure threshold PSTh2, and a third discharge pressure threshold PSTh3 (step S31) as shown in FIG. 6. Among these discharge pressure thresholds PSTh1 to PSTh3, the third discharge pressure threshold PSTh3 is highest, the second discharge pressure threshold PSTh2 is second highest, and the first discharge pressure threshold PSTh1 is lowest. The third discharge pressure threshold PSTh3 is a discharge pressure threshold for determining whether to set the upper limit NELm for the engine rotation speed NE using the discharge pressure sensor value PS. In the present embodiment, the upper limit NELm is set for the engine rotation speed NE when the discharge pressure sensor value PS is less than the third discharge pressure threshold PSTh3. In addition, the first discharge pressure threshold PSTh1 and the second discharge pressure threshold PSTh2 are upper limit setting thresholds for determining the value of the upper limit NELm.

In the present embodiment, the discharge pressure thresholds PSTh1 to PSTh3 are set using the map shown in FIG. 7. The oil pump 10 is a pump that is driven in synchronization with rotation of the crankshaft. Therefore, the discharge pressure sensor value PS is expected to be greater when the engine rotation speed NE is high than when the engine rotation speed NE is relatively low. Therefore, each of the discharge pressure thresholds PSTh1 to PSTh3 increases as the engine rotation speed NE increases. When the target discharge pressure PTr has been derived through execution of the change process, the discharge pressure thresholds PSTh1 to PSTh3 are less than the target discharge pressure PTr.

Referring back to FIG. 6, when the derivation of the discharge pressure thresholds PSTh1 to PSTh3 is completed, the upper limit setting section 304 determines whether the discharge pressure sensor value PS is less than the first discharge pressure threshold PSTh1 (step S32). When the discharge pressure sensor value PS is less than the first discharge pressure threshold PSTh1, the discharge pressure sensor value PS is naturally less than the third discharge pressure threshold PSTh3, and the upper limit NELm needs to be set for the engine rotation speed NE. Therefore, when the discharge pressure sensor value PS is less than the first discharge pressure threshold PSTh1 (step S32: YES), the upper limit setting section 304 equalizes the upper limit NELm with the first upper limit NE1, and outputs NELm (NELm=NE1) to the injection controlling section 306 (step S33). Thereafter, the upper limit setting section 304 moves the process to step S92, which will be discussed below.

If the discharge pressure sensor value PS is greater than or equal to the first discharge pressure threshold PSTh1 (NO) in step S32, the upper limit setting section 304 determines whether the discharge pressure sensor value PS is less than the second discharge pressure threshold PSTh2 (Step S34). When the discharge pressure sensor value PS is less than the second discharge pressure threshold PSTh2, the discharge pressure sensor value PS is naturally less than the third discharge pressure threshold PSTh3, and the upper limit NELm needs to be set for the engine rotation speed NE. Therefore, when the discharge pressure sensor value PS is less than the second discharge pressure threshold PSTh2 (step S32: YES), the upper limit setting section 304 equalizes the upper limit NELm with the second upper limit NE2, which is greater than the first upper limit NE1, and outputs NELm (NELm=NE2) to the injection controlling section 306 (step S35). Thereafter, the upper limit setting section 304 moves the process to step S92, which will be discussed below.

If the discharge pressure sensor value PS is greater than or equal to the second discharge pressure threshold PSTh2 (NO) in step S34, the upper limit setting section 304 determines whether the discharge pressure sensor value PS is less than the third discharge pressure threshold PSTh3 (Step S36). When the discharge pressure sensor value PS is less than the third discharge pressure threshold PSTh3, it is necessary to set the upper limit NELm for the engine rotation speed NE. When the discharge pressure sensor value PS is greater than or equal to the third discharge pressure threshold PSTh3, it is not necessary to set the upper limit NELm for the engine rotation speed NE. Therefore, when the discharge pressure sensor value PS is less than the third discharge pressure threshold PSTh3 (step S36: YES), the upper limit setting section 304 equalizes the upper limit NELm with the third upper limit NE3, which is greater than the second upper limit NE2, and outputs NELm (NELm=NE3) to the injection controlling section 306 (step S37). Thereafter, the upper limit setting section 304 moves the process to step S92, which will be discussed below.

In step S38, the upper limit setting section 304 stores the limitation operation history in the memory section 305. Thereafter, the upper limit setting section 304 ends this processing routine.

If the discharge pressure sensor value PS is greater than or equal to the third discharge pressure threshold PSTh3 (NO) in step S36, the upper limit setting section 304 outputs a command to stop the execution of the change process of the target discharge pressure PTr to the target changing section 302 and does not set the upper limit NELm (step S39). Thereafter, the upper limit setting section 304 ends this processing routine.

Next, referring to FIGS. 8A, 8B, and 8C, the operation after the engine 200 starts will be described together with the advantages.

As indicated by the solid line in FIG. 8A, the target discharge pressure PTr starts being maintained at a first point in time t11 after the engine 200 is started. In the example shown in FIGS. 8A to 8C, the target discharge pressure PTr deviates from the discharge pressure sensor value PS, and the difference ΔPS between the target discharge pressure PTr and the discharge pressure sensor value PS continues to be greater than the difference threshold ΔPSTh as shown in FIG. 8A. At a second point in time t12, the duration Tm of that state reaches the duration threshold TmTh. In this case, since it can be determined that there may be an abnormality in the control of the oil discharge pressure of the oil pump 10, the target discharge pressure PTr is derived through the change process as shown in FIG. 8B. As shown in FIG. 8A, the target discharge pressure PTr is set to be greater than before it is determined that there may be an abnormality in the control of the oil discharge pressure in an attempt to increase the amount of oil the engine 200 can supply to the respective devices 203.

In a case in which the oil control valve 100, the oil pump 10, and the temperature sensor 312 are normal, if the target discharge pressure PTr is set to be greater than the reference target discharge pressure PTrB through the change process, the target discharge pressure PTr becomes greater than the third discharge pressure threshold PSTh3. When the delay time TD has elapsed from the second point in time t12 (a third point in time t13 in FIG. 8), the discharge pressure sensor value PS is expected to have been sufficiently increased due to an increase in the target discharge pressure PTr, so that the processing routine shown in FIG. 6 is executed.

At this time, if the adjuster ring 70 of the oil pump 10 is displaced to the position shown in FIG. 2, the discharge pressure sensor value PS has been increased to the target discharge pressure PTr. That is, the discharge pressure sensor value PS is greater than the third discharge pressure threshold PSTh3. In this case, since it cannot be determined that there is an abnormality in the control of the oil discharge pressure of the oil pump 10, the derivation of the target discharge pressure PTr through the change process is not executed. That is, the target discharge pressure PTr is derived through a normal derivation process, and the operation of the oil pump 10 is controlled based on this target discharge pressure PTr.

However, if the adjuster ring 70 cannot be displaced to the position shown in FIG. 2 even by increasing the target discharge pressure PTr through the change process, the discharge pressure sensor value PS is less than the third discharge pressure threshold PSTh3 at a third point in time t13 as shown in FIG. 8A. In this case, since it can be determined that there is an abnormality in the control of the oil discharge pressure of the oil pump 10, the upper limit NELm is set for the engine rotation speed NE as indicated by the broken line in FIG. 8C.

At the third point in time t13, although the discharge pressure sensor value PS is less than the third discharge pressure threshold PSTh3 as shown in FIG. 8A, the discharge pressure sensor value PS is greater than the first discharge pressure threshold PSTh1 and the second discharge pressure threshold PSTh2. Therefore, as shown in FIG. 8C, the upper limit NELm is equalized with a third upper limit NE3, which is greater than the first upper limit NE1 and the second upper limit NE2.

As described above, the greater the amount of oil able to be supplied to the devices 203 by driving the oil pump 10 at that time, the greater the upper limit NELm can be set. Therefore, in case in which the oil discharge pressure of the oil pump 10 is relatively high, even if the engine rotation speed NE increases from a fourth point in time t14, the engine rotation speed NE is unlikely to reach the upper limit NELm. Therefore, even when the upper limit NELm is set for the engine rotation speed NE, acceleration of the vehicle will not be poor. In contrast, the smaller the amount of oil able to be supplied to the devices 203 due to a low oil discharge pressure, the lower the upper limit NELm can be set. For example, if the discharge pressure sensor value PS is less than the first discharge pressure threshold PSTh1 at the time when the processing routine shown in FIG. 6 is executed, the upper limit NELm is equalized with the upper limit NE1, which is the lowest one among the three upper limits NE1, NE2, and NE3. Thus, when the oil discharge pressure is relatively low, the engine rotation speed NE tends to reach the upper limit NELm, and it is possible to suppress an increase in the oil demand at the devices 203. This limits an increase in the deviation between the demand for oil at the devices 203 and the amount of oil that is actually supplied to the devices 203.

That is, with the present embodiment, the value of the upper limit NELm is determined in accordance with the value of the discharge pressure sensor value PS when the target discharge pressure PTr is increased through the change process. Therefore, it is possible to achieve compatibility between suppression of an increase in the oil demand at the oil demanding portions including the devices 203 and prevention of poor acceleration of the vehicle.

In the present embodiment, when deriving the target discharge pressure PTr through the change process, the target discharge pressure PTr is increased to the maximum value of the oil discharge pressure of the oil pump 10 at that time. That is, when it is determined that there may be an abnormality in the control of the oil discharge pressure, the oil discharge pressure can be maximized. Therefore, the upper limit NELm for the engine rotation speed NE can be set in accordance with the maximum discharge performance of the oil pump 10 at that time. This maximally suppresses poor vehicle acceleration, while inhibiting the shortage of oil supplied to the oil demanding portions.

When the oil pump 10 can be driven normally, the oil discharge pressure of the oil pump 10 increases as the engine rotation speed NE increases. Thus, the third discharge pressure threshold PSTh3 is increased as the engine rotation speed NE increases. The third discharge pressure threshold PSTh3 can be set greater when the oil discharge pressure is expected to be relatively high than when the discharge pressure is not expected to be relatively high. As a result, since the third discharge pressure threshold PSTh3 can be set to an appropriate value, it is possible to increase the accuracy of determination as to whether the upper limit NELm should be set for the engine rotation speed NE.

Also, in the present embodiment, in addition to the third discharge pressure threshold PSTh3, the first discharge pressure threshold PSTh1 and the second discharge pressure threshold PSTh2 are also increased as the engine rotation speed NE increases. Thus, the upper limit NELm can be set greater when an increase in the engine rotation speed NE is expected to make the oil discharge pressure relatively high than when an increase in the engine rotation speed NE is not expected increase the oil discharge pressure significantly. Therefore, increase in the engine rotation speed NE is prevented from being limited despite the fact that the discharge pressure of the oil can be increased.

If the upper limit NELm is set for the engine rotation speed NE during the operation of the engine 200, the limitation operation history, which is the operation history indicating the setting of the upper limit NELm, is stored in the memory section 305. In this case, since the limitation operation history is stored in the memory section 305 during the current operation of this engine 200, it is possible to start the control of the oil discharge pressure of the oil pump 10 using the target discharge pressure PTr (PTr>PTrB), which is derived through execution of the change process before the duration Tm becomes longer than or equal to the duration threshold TmTh. This expedites the determination of whether the upper limit NELm should be set for the engine rotation speed NE. When the discharge pressure sensor value PS is less than the third discharge pressure threshold PSTh3, the upper limit NELm can be equalized with a value that corresponds to the engine rotation speed NE (any one of NE1, NE2, and NE3). This allows the engine 200 to operate with the upper limit NELm set at an early stage.

On the other hand, when the discharge pressure sensor value PS becomes greater than or equal to the third discharge pressure threshold PSTh3, the oil discharge pressure of the oil pump 10 is controlled normally during the operation of the current engine 200. It thus can be determined that a sufficient amount of oil can be supplied to the devices 203, so that the upper limit NELm is not set for the engine rotation speed NE. That is, even if the upper limit NELm was set due to a relatively small amount of oil that was able to be supplied to the devices 203 during the previous operation of the engine 200, the upper limit NELm is not set in the current operation of the engine 200 if a sufficient amount of oil can be supplied to the devices 203. This configuration prevents an upper limit NELm from being set unnecessarily.

If the oil pump 10 is driven in a state in which the target discharge pressure PTr is increased through execution of the change process, an abnormality in the control of the oil discharge pressure may be eliminated. Accordingly, in the present embodiment, when the discharge pressure sensor value PS in a situation in which the oil discharge pressure is being controlled based on the target discharge pressure PTr increased through execution of the change process becomes greater than or equal to the third discharge pressure threshold PSTh3, it can be determined that the abnormality in the control of the oil discharge pressure has been eliminated. For this reason, the oil discharge pressure is controlled based on the target discharge pressure PTr derived through the normal derivation process. This prevents the devices 203 from being supplied with excessive of oil. Therefore, deterioration of the fuel economy of the engine 200 is limited.

The above described embodiment may be modified as follows.

The upper limit NELm is set for the engine rotation speed NE when the discharge pressure sensor value PS does not become greater than or equal to the third discharge pressure threshold PSTh3 even if the target discharge pressure PTr is increased through the change process. In this case, the limitation operation history does not necessarily need to be stored in the memory section 305. In this case, even if the upper limit NELm was set in the previous operation of the engine 200, the derivation of the target discharge pressure PTr through the change process and the determination of whether to set the upper limit NELm are not performed as long as the duration Tm of a state in which the above-described difference ΔPS is greater than or equal to the difference threshold ΔPSTh does not become longer than or equal to the duration threshold TmTh during the current operation of the engine 200. In contrast, the derivation of the target discharge pressure PTr through the change process and the determination of whether to set the upper limit NELm are performed when the duration Tm of the state in which the difference ΔPS is greater than or equal to the determination threshold ΔPSTh becomes longer than or equal to the duration threshold TmTh.

Since the oil pump 10 is an engine driven pump, the driving speed of the oil pump 10 is proportional to the engine rotation speed NE. The discharge pressure thresholds PSTh1 to PSTh3 may be discretely increased if the discharge pressure thresholds PSTh1 to PSTh3 can be set greater when the engine rotation speed NE is relatively high, that is, when the driving speed of the oil pump 10 is relatively high than when the driving speed is relatively low. For example, a threshold for the engine rotation speed NE may be set. In this modification, when the engine rotation speed NE is less than the threshold, the discharge pressure thresholds PSTh1 to PSTh3 are maintained at values for engine rotation speeds less than the threshold. When the engine rotation speed NE is greater than or equal to the threshold, the discharge pressure thresholds PSTh1 to PSTh3 are maintained at values for engine rotation speeds greater than the threshold. The values for engine rotation speeds greater than the threshold are greater than the values for engine rotation speeds less than the threshold.

In the above-described embodiment, a gear pump is used as the oil pump 10, but the oil pump 10 may any kind of pump other than a gear pump (for example, a vane pump).

The oil pump may be an electric pump instead of an engine driven pump. Even in this case, it is possible to control the oil discharge pressure of the oil pump by adjusting the driving speed of the oil pump.

In the above-described embodiment, the two discharge pressure thresholds PSTh1, PSTh2 are prepared as the upper limit setting thresholds, so that the upper limit NELm for the engine rotation speed NE can be set in three stages. However, any number that is greater than or equal to three (for example, four) of discharge pressure thresholds may be provided as the upper limit setting thresholds, or only one upper limit setting threshold may be provided. Alternatively, instead of setting the upper limit NELm discretely, the upper limit NELm may be gradually increased as the discharge pressure sensor value PS increases.

In the above-described embodiment, the target discharge pressure PTr, which is derived through the change process, is equal to the maximum value of the oil discharge pressure able to be set at that time. However, the present disclosure is not limited to this. In the change process, the target discharge pressure PTr may be less than the maximum value of the oil discharge pressure able to be set at that time as long as the target discharge pressure PTr is higher than the target discharge pressure PTr that is derived through the normal derivation process, that is, the reference target discharge pressure PTrB. For example, in the change process, the target discharge pressure PTr may be set to a product that is obtained by multiplying, by a value less than 1 (for example, 0.8), the maximum value of the oil discharge pressure able to be set at that time. In addition, in the change process, the target discharge pressure PTr may be set to the sum that is obtained by adding a predetermined offset value to the reference target discharge pressure PTrB.

The method of determining whether there may be an abnormality in the control of the oil discharge pressure may be a method different from the method using the duration Tm as described in the above-described embodiment. For example, even if the engine 200 starts operating and the temperature of the coolant circulating the engine 200 increases, the oil temperature TMP does not increase in some cases. In such a case, it can be determined that there may be an abnormality in the temperature sensor 312, and there may be an abnormality in the control of the oil discharge pressure.

In the above-described embodiment, when the discharge pressure sensor value PS becomes greater than or equal to the third discharge pressure threshold PSTh3 in a situation in which the oil discharge pressure of the oil pump 10 is being controlled with the target discharge pressure PTr derived through the change process, the control of the oil discharge pressure based on the target discharge pressure PTr derived through the change process is switched to the control of the oil discharge pressure based on the target discharge pressure PTr derived through the normal derivation process. However, when the discharge pressure sensor value PS becomes greater than or equal to the third discharge pressure threshold PSTh3, the control of the oil discharge pressure based on the target discharge pressure PTr derived through the change process may be continued even if the upper limit NELm is not set for the engine rotation speed NE.

The lower the oil temperature TMP, the higher the viscosity of the oil becomes. Accordingly, the oil discharge pressure of the oil pump 10 tends to be relatively high. Thus, the third discharge pressure threshold PSTh3 may be increased as the oil temperature TMP increases. In addition, the first discharge pressure threshold PSTh1 and the second discharge pressure threshold PSTh2 may be increased as the oil temperature TMP increases.

The invention claimed is:

1. A control device for an onboard engine, the onboard engine including an oil pump configured to circulate oil within the onboard engine and change a discharge pressure of the oil and a sensor configured to detect a pressure of the oil discharged from the oil pump, the control device comprising:

circuitry configured to:

control the oil discharge pressure of the oil pump based on a target discharge pressure that is a target value of a discharge pressure set for the oil pump and a discharge pressure sensor value that is a pressure of oil detected by the sensor;

determine whether there may be an abnormality in the control of the oil discharge pressure;

when the circuitry determines that there may be the abnormality in the control of the oil discharge pressure, execute a change process in which the target discharge pressure is increased to a value that is greater than a value of the target discharge pressure before it is determined that there may be the abnormality in the control of the oil discharge pressure; and when the discharge pressure sensor value, in a situation in which the circuitry is controlling the oil discharge pressure based on the target discharge pressure increased through execution of the change process, does not become greater than or equal to a discharge pressure threshold that is less than the target discharge pressure increased through the execution of the change process:

set an upper limit for an engine rotation speed, and increase the upper limit as the discharge pressure sensor value increases.

2. The control device for the onboard engine according to claim 1, wherein the circuitry is configured to determine that there may be the abnormality in the control of the oil discharge pressure when a duration of a state, in which a difference between the discharge pressure sensor value and the target discharge pressure is greater than or equal to a difference threshold, becomes longer than or equal to a duration threshold.

3. The control device for the onboard engine according to claim 1, wherein the circuitry is configured to, in the change process, equalize the target discharge pressure with a maximum target discharge pressure that is a maximum value of the target discharge pressure able to be set for the oil pump.

4. The control device for the onboard engine according to claim 1, wherein the oil pump is configured to be driven in synchronization with rotation of a crankshaft of the engine, and the circuitry is configured to set the discharge pressure threshold greater when the engine rotation speed is relatively high than when the engine rotation speed is relatively low.

5. The control device for the onboard engine according to claim 1, wherein the circuitry is configured to, when setting the upper limit for the engine rotation speed, set the upper limit greater when the discharge pressure sensor value is greater than or equal to an upper limit setting threshold that is less than the discharge pressure threshold than when the discharge pressure sensor value is less than the upper limit setting threshold.

6. The control device for the onboard engine according to claim 1, further comprising a memory that stores a limitation operation history that is an operation history indicating operation of the onboard engine in a state in which the upper limit is set for the engine rotation speed, wherein the circuitry is configured to:

when the memory stores the limitation operation history at a starting of the onboard engine, execute the change process regardless of whether the circuitry has determined that there may be the abnormality in the control of the oil discharge pressure, and in a situation in which the circuitry is controlling the oil discharge pressure based on the target discharge pressure increased through the execution of the change process:

set the upper limit in accordance with the discharge pressure sensor value when the discharge pressure sensor value is not greater than or equal to the discharge pressure threshold, and not set the upper limit when the discharge pressure sensor value is greater than or equal to the discharge pressure threshold.

7. The control device for the onboard engine according to claim 1, wherein the circuitry is configured to end the execution of the change process when the discharge pressure sensor value, in a situation in which the circuitry is controlling the oil discharge pressure based on the target discharge pressure increased through the execution of the change process, is greater than or equal to the discharge pressure threshold.

8. A control method for an onboard engine, the onboard engine including an oil pump configured to circulate oil within the onboard engine and change a discharge pressure of the oil and a sensor configured to detect a pressure of oil discharged from the oil pump, the control method comprising:

controlling the oil discharge pressure of the oil pump based on a target discharge pressure that is a target value of a discharge pressure set for the oil pump and a discharge pressure sensor value that is a pressure of oil detected by the sensor;

determining whether there may be an abnormality in the control of the oil discharge pressure;

when it is determined that there may be the abnormality in the control of the oil discharge pressure, executing a change process to increase the target discharge pressure to a value that is greater than a value of the target discharge pressure before it is determined that there may be an abnormality in the control of the oil discharge pressure; and when the discharge pressure sensor value, in a situation in which the oil discharge pressure is being controlled based on the target discharge pressure increased through execution of the change process, does not become greater than or equal to a discharge pressure threshold that is less than the target discharge pressure increased through the execution of the change process:

setting an upper limit for an engine rotation speed, and increasing the upper limit as the discharge pressure sensor value increases.

9. The control device for the onboard engine according to claim 1, wherein the circuitry is configured to set the upper limit for the engine rotation speed to a first upper limit engine rotation speed when the discharge pressure sensor value is less than a first discharge pressure threshold.

10. The control device for the onboard engine according to claim 9, wherein the circuitry is configured to set the upper limit for the engine rotation speed to a second upper limit engine rotation speed that is greater than the first upper limit engine rotation speed when the discharge pressure sensor value is greater than the first discharge pressure threshold and less than a second discharge pressure threshold that is greater than the first discharge pressure threshold.

11. The control device for the onboard engine according to claim 10, wherein the circuitry is configured to set the upper limit for the engine rotation speed to a third upper limit engine rotation speed that is greater than the second upper limit engine rotation speed when the discharge pressure sensor value is greater than the second discharge pressure threshold and less than a third discharge pressure threshold that is greater than the second discharge pressure threshold.

12. The control device for the onboard engine according to claim 11, wherein the circuitry is configured to end the execution of the change process when the discharge pressure sensor value is greater than or equal to the third discharge pressure threshold.

13. An apparatus comprising:

an engine including:

an oil pan, an oil gallery, and an oil pump configured to circulate oil within the engine between the oil gallery and the oil pan and change a discharge pressure of the oil;

a sensor configured to detect a pressure of the oil discharged from the oil pump; and a control device comprising circuitry configured to:

control the oil discharge pressure of the oil pump based on a target discharge pressure that is a target value of a discharge pressure set for the oil pump and a discharge pressure sensor value that is a pressure of oil detected by the sensor;

determine whether there may be an abnormality in the control of the oil discharge pressure;

when the circuitry determines that there may be the abnormality in the control of the oil discharge pressure, execute a change process in which the target discharge pressure is increased to a value that is greater than a value of the target discharge pressure before it is determined that there may be the abnormality in the control of the oil discharge pressure; and when the discharge pressure sensor value, in a situation in which the circuitry is controlling the oil discharge pressure based on the target discharge pressure increased through execution of the change process, does not become greater than or equal to a discharge pressure threshold that is less than the target discharge pressure increased through the execution of the change process:

set an upper limit for an engine rotation speed, and increase the upper limit as the discharge pressure sensor value increases.

* * * * *